US005417425A

United States Patent [19]

Blumberg et al.

[11] Patent Number: 5,417,425

[45] Date of Patent: May 23, 1995

[54] PUZZLE DEVICE

[75] Inventors: Revital Blumberg, Karmiel; Michael Ganor, 27 Shocken, 66532 Tel Aviv; Avish J. Weiner, 12 Boyer, 69127 Tel Aviv, all of Israel

[73] Assignees: Michael Ganor; Avish J. Weiner, both of Tel Aviv, Israel

[21] Appl. No.: 225,291

[22] Filed: Apr. 8, 1994

[51] Int. Cl.[6] ..... A63F 9/00

[52] U.S. Cl. ..... 273/153 R; 273/460

[58] Field of Search ..... 273/153 R, 237, 460; 434/236, 237, 258, 259

[56] References Cited

U.S. PATENT DOCUMENTS

| | | | |
|---|---|---|---|
| 2,870,549 | 1/1959 | Craine | 434/236 |
| 4,169,592 | 10/1979 | Hall | 434/258 X |
| 4,240,638 | 12/1980 | Morrison et al. | 273/237 |
| 4,863,172 | 9/1989 | Rosenwinkel et al. | 273/153 R X |
| 5,215,311 | 6/1993 | Schuller | 273/153 R X |
| 5,286,037 | 2/1994 | Ghaly | 273/153 R X |

*Primary Examiner*—William H. Grieb
*Attorney, Agent, or Firm*—Mark M. Friedman

[57] ABSTRACT

A puzzle device which includes an array of indicators, each of the indicators capable of alternately indicating a first state or a second state; means for selecting one of the array of indicators; and means for changing, upon the selection of one of the array of indicators, the state of at least one of the other of the indicators based on a pre-determined pattern.

16 Claims, 4 Drawing Sheets

PUZZLE DEVICE

FIELD AND BACKGROUND OF THE INVENTION

The present invention relates to puzzles and devices for implementing puzzles.

A wide variety of puzzle and puzzle devices are available. These include both mechanical and electronic puzzles. Typically, the user is required to solve a problem or reach an objective through the actual or imaginary manipulation, using preset rules or constraints, of a series of real or virtual objects. Illustrative of such puzzles is the well-known Rubic's Cube wherein the user is required to rotate sections of a cube, each of which is made up of smaller cubes having differently colored sides, in order to align the smaller cubes so as to cause each of the sides of the cube to be of a single color.

SUMMARY OF THE INVENTION

According to the present invention there is provided a puzzle device, comprising: (a) an array of indicators, each of the indicators capable of alternately indicating a first state or a second state; (b) means for selecting one of the array of indicators; and (c) means for changing, upon the selection of the one of the array of indicators, the state of at least one of the other of the indicators based on a pre-determined pattern.

According to further features in preferred embodiments of the invention described below, the indicators are visual indicators, such as differently colored lights or lights which can be either on or off.

According to still further features in the described preferred embodiments, the indicators are touch screens, preferably using LCD's, most preferably with back-lighting, or which can be an array of switches each of which preferably includes an LED.

The present invention provides entertaining and challenging puzzles which can be implemented as a stand-alone unit, as a video game, as a computer game or in other formats.

A puzzle device according to the present invention includes an array of indicators, each of which is capable of alternately indicating a first state or a second state. The puzzle device also includes means for sequentially selecting any of the indicators. Finally, the puzzle device includes means for changing the state of one or more of the indicators based on a preset format or pattern upon the selection of one of the indicators.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a puzzle which can be implemented in a wide variety of media or formats. The essence of a puzzle device according to the present invention is the presentation to the user of an array of indicators. Each of the indicators is capable of alternately displaying one of two states, e.g., lit and not lit. The user is able to sequentially select any of the indicators. Each time an indicator is selected, at least one of the non-selected indicators changes states according to some pre-determined or pre-selected pattern. The objective is to go from a starting configuration of indicator states to a desired configuration of indicator states, e.g., to go from a configuration wherein some of the indicators are in each of the two states to a configuration wherein all the indicators are of the same state, and the like.

The principles and operation of a puzzle according to the present invention may be better understood with reference to the drawings and the accompanying description.

Figure 1:
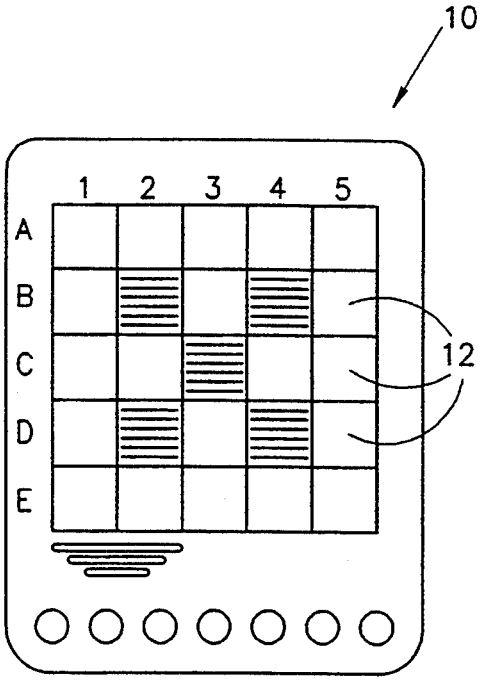
FIGS. 1–4 show four illustrative patterns for use with a puzzle according to the present invention.

Referring now to the drawings, FIG. 1 illustrates one possible form of a device for implementing a puzzle according to the present invention. The device 10 includes an array of indicators 12 each of which is capable of alternately indicating a first state or a second state.

The array of indicators 12 can be linear (one dimensional) or three-dimensional, but is preferably two-dimensional, as illustrated in the drawings. The two-dimensional array may be planar, as shown in the Figures, or may be wrapped in three-dimensional space, for example to form the six sides of a cube or to form a substantially spherical configuration. The two-dimensional array, which may be of any desired size, may be rectangular, but is preferably square. Square arrays of $4\times4$ or $5\times5$ are considered to be highly desirable for many applications.

Each of indicators 12 is capable of alternately indicating at least two states. As will be clear to the reader, more than two states may be used. However, for ease of presentation, the description herein is limited to the case wherein each indicator 12 is capable of displaying one of only two states. The indications of state may be by any suitable means, preferably a visual indicator showing one of two colors, most preferably a light (which may be colored) which is either lit or not lit. Several possible indicators 12 are described in more detail below. Other indicators may be envisioned including, but not limited to, various electro-mechanical devices such as an array of pistons which can alternately be pushed up or down in response to the selection of one of the indicator positions.

A device implementing a puzzle according to the present invention includes means for selecting one of indicators 12, which may involve touching or moving indicator 12 itself or an element which is suitably connected to indicator, as is described in more detail below.

Finally, a device according to the present invention includes suitable display activating means which, upon the selection of one of indicators, change the state of at least one of the non-selected indicators, perhaps also changing the state of the selected indicator. The determination of which indicators change state upon the selection of one of the indicators is made based on a preset pattern or algorithm.

Examples of four of the many possible patterns are shown in FIGS. 1–4. In each of the figures it is assumed, for purposes of exposition, that the user selects the central indicator (element C3) of an array initially having all indicators 12 of the same state (blank). FIGS. 1–4 show the state of the array immediately after the selection of element C3.

In FIG. 1 five indicators change state—the selected indicator and the four indicators adjacent to the selected indicator along the diagonal (elements B2, B4, D2 and D4).

Figure 2:
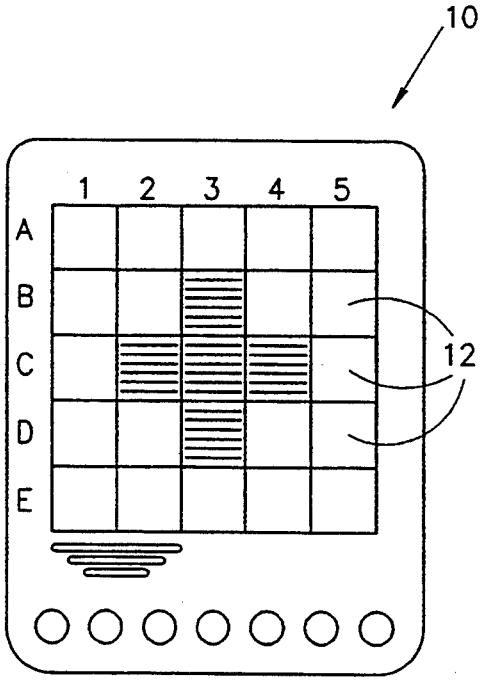

In FIG. 2 five indicators change state—the selected indicator and the four indicators adjacent to the selected element in the same row or column as the selected indicator (elements B3, C2, C4 and D3).

Figure 3:
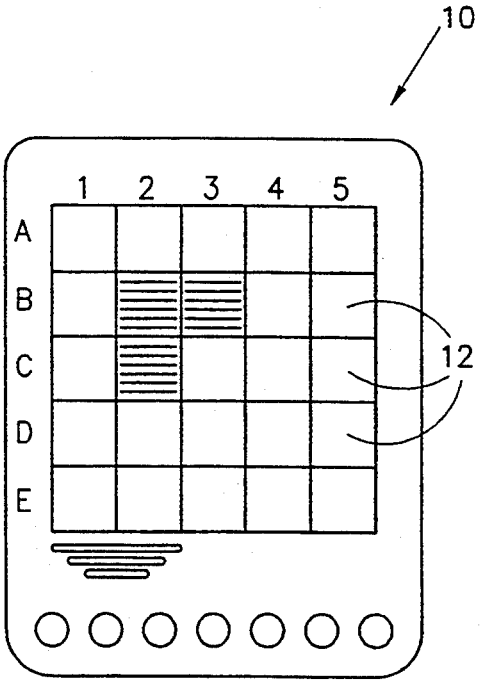

In FIG. 3 three indicators change state—the two indicators adjacent to the selected indicator to the left and above and the diagonal indicator between the two other indicators (elements B2, B3 and C2).

Figure 4:
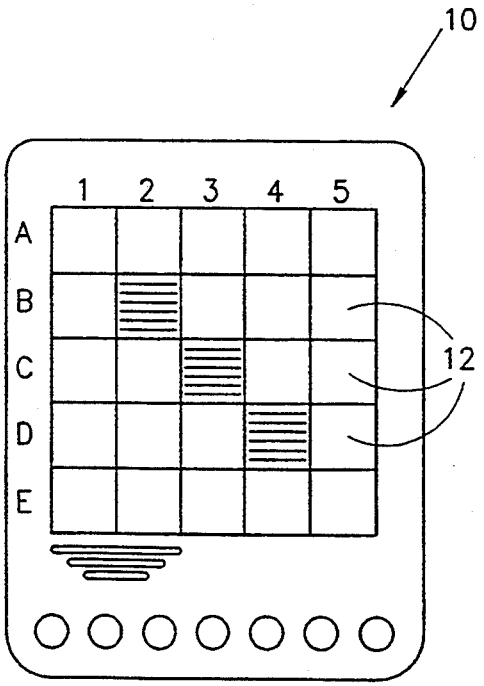

In FIG. 4 three indicators change state—the selected indicator and the two indicators adjacent to the selected indicator on the diagonal above and to the left and below and to the right (elements B2 and D4).

Figure 5:
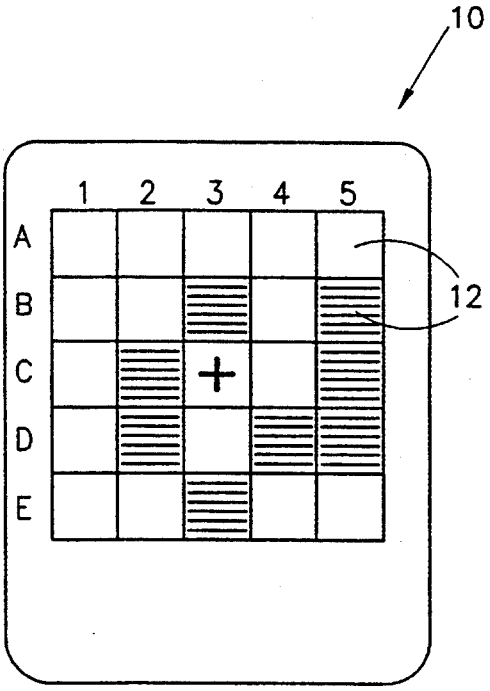
FIGS. 5–8 illustrate a sequence of three moves using the pattern in FIG. 2.

Illustrated in FIGS. 5–8 is a sequence of three selections using the pattern of FIG. 2. FIG. 5 shows a typical starting position with some of indicators 12 being in one state while the rest are in a second state. When indicator C3 is selected (indicated by X in FIG. 5) the result is the configuration of FIG. 6. It is to be noted that indicators C3 as well as B3, C2, C4 and D3 have changed state.

Figure 6:
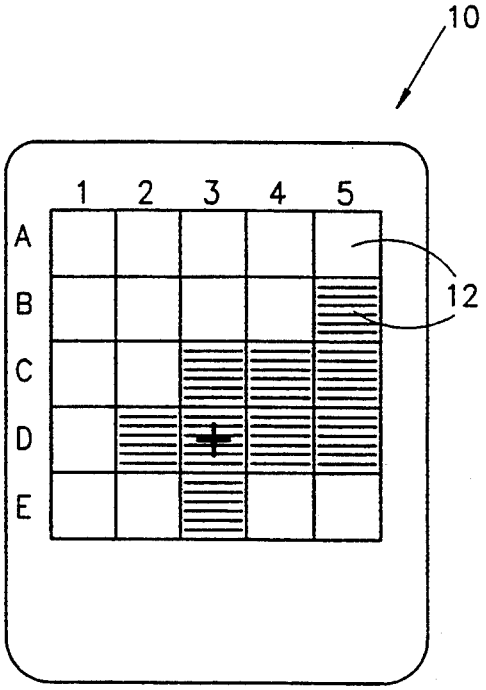
Figure 7:
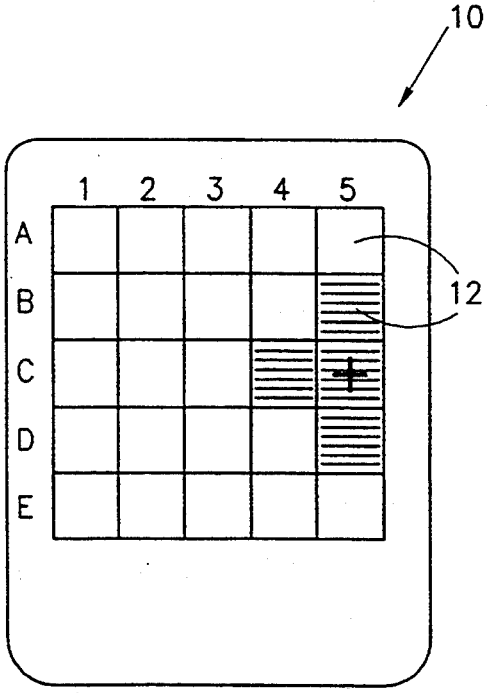

The next selection is indicator D3 (X in FIG. 6). When D3 is selected the result is shown in FIG. 7. It is to be noted that indicators D3 as well as C3, D2, D4 and E3 have changed state.

Figure 8:
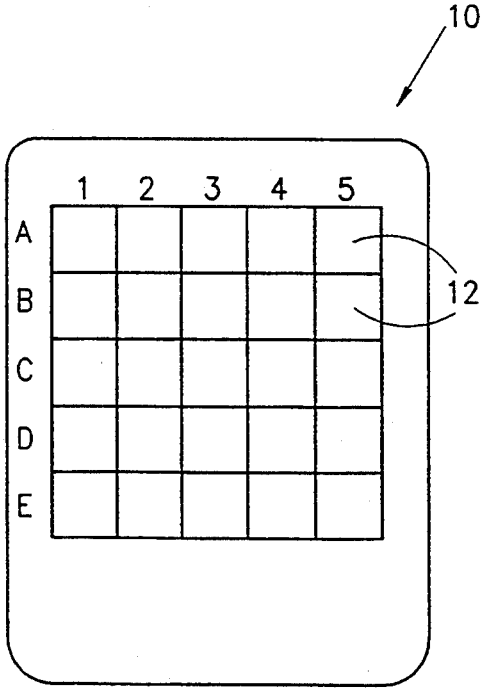

Finally, when C5 is selected (X in FIG. 7), the result is an array wherein all indicators 12 are of the same state, as shown in FIG. 8. It is to be noted that indicators B5, C4, C5 and D5 have changed states while the fifth element of the pattern is beyond the edge of the 5×5 array and is thus not involved. As will be readily appreciated, in an alternative embodiment not shown in the Figures, the fifth element could be involved using wraparound, i.e., indicator C1 can be thought of as being immediately adjacent indicator C5 and thus, when indicator C5 is selected indicator C1 could change state. It is to be further noted that if the objective of the manipulation had been to get from the indicator configuration of FIG. 5 to a situation wherein all indicators 12 are of the same state, then the objective would have been satisfied through the series of three moves described in FIGS. 5–8.

It will be readily appreciated that a puzzle device according to the present invention may be implemented in a number of ways including, but not limited to, a stand-alone hand-held game, as a video game or as part of a video game set, or as a computer game.

For illustrative purposes, a description of one possible stand-alone hand-held unit having a square planar array of indicators is given herein. Such a system is depicted schematically in FIG. 9. The system includes a display matrix 20 for displaying the state of each of indicators 12. The system also includes selection input means for selecting an indicator. The selection input means may, for example, be a transparent touch screen overlay, a keyboard matrix or various switches or other controls 22. Preferably, as is described in more detail below, display matrix 20 and keyboard matrix 22 are implemented in the same equipment which makes it most convenient for the user to select the desired indicator.

Figure 9:
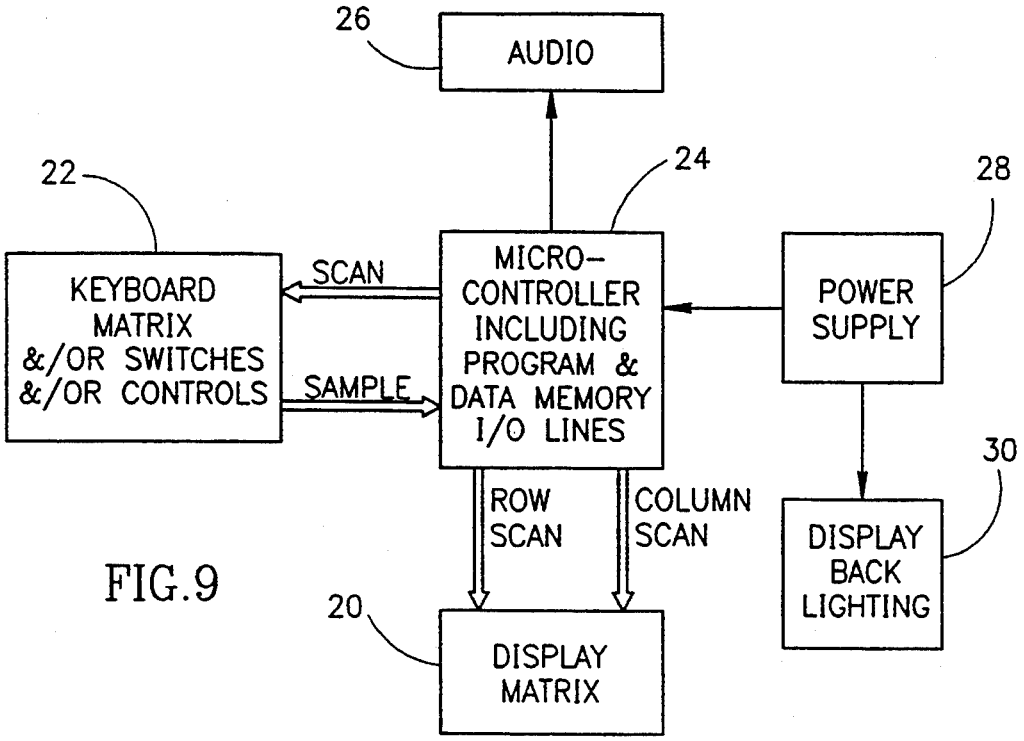
FIG. 9 schematically depicts a possible configuration of a device implementing a puzzle according to the present invention.

The system shown in FIG. 9 further includes a suitable micro-controller 24 for changing the states of the various indicators based on the selections by the user and for carrying out various other functions, some of which are described in more detail below. For example, micro-controller 24 may control an audio device 26 which may be used to provide feedback information, hints and the like to the user. A power supply 28, such as a suitable battery, supplies power to micro-controller 24 and to the other energy-consuming components, including the lighting mechanisms, such as back-lighting 30, of the display matrix 20.

Figure 10:
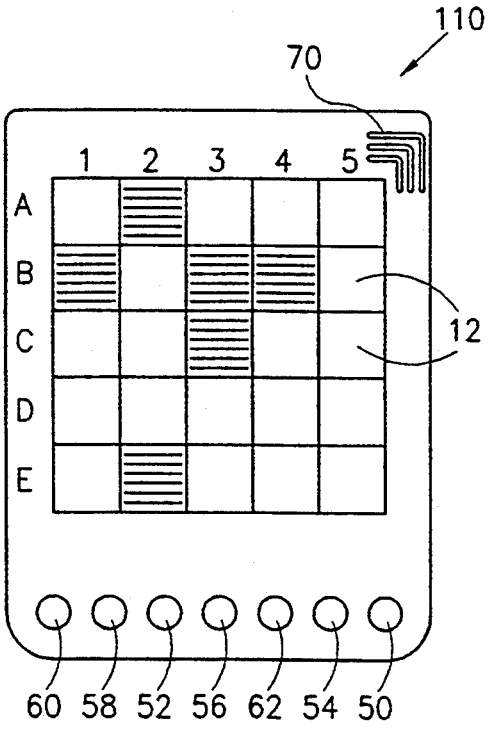
FIG. 10 shows one possible configuration of a device implementing a puzzle according to the present invention.
Figure 11:
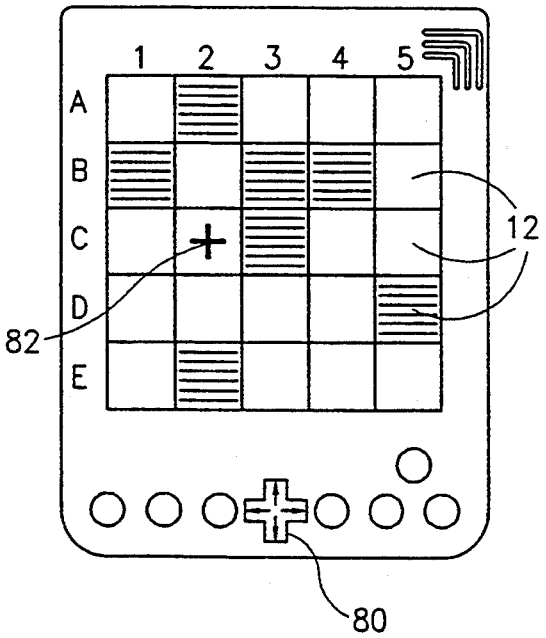
FIG. 11 is another possible configuration of a device implementing a puzzle according to the present invention.

Two possible configurations of a stand-alone puzzle device according to the present invention are depicted in FIGS. 10 and 11. The devices may include a number of optional functions which are described in the context of the various input buttons of FIG. 10.

An ON/OFF button 50 is used to turn the device on or off.

The pattern to be used can be selected using the PATTERN button 52. The selection can be effected prior to the start of a new game in any suitable manner. For example, a number of fixed patterns (such as those shown in FIGS. 1–4) can be stored in the device. Pressing PATTERN button 52 can serve to scroll through the various available patterns until a desired pattern appears and is selected. The device can include a single default pattern (e.g., that shown in FIG. 2) which will be used in the absence of a selection of an alternative pattern. It may also be desirable to give the user the ability to create and use one or more patterns of his own design.

When the user desires to start a game, the START button 54 is pressed. Pressing START 54 erases the display and gives the user a new starting display (such as the one shown in FIG. 10) which can be generated in any of a number of ways. One way of generating a starting display is to store a number of such starting displays in the micro-controller memory and to present one of the stored displays sequentially or, preferably, by random selection.

Another way of generating a starting display is to allow the user to select the starting display by selecting the desired indicator one at a time. Thus, for example, the user could depress a PRIVATE button 56 which will allow the user to then sequentially select each indicator whose state the user wishes to reverse so that the user can create his own private starting board. A disadvantage of this method of generating a starting display is that there is no guarantee that will be possible to go from the starting display to a desired solution for the particular pattern selected. To overcome this advantage, in a variation of this embodiment the device could be made to display for the user the best solution which may be reached so that the user has a better idea of his objective.

Yet another, and a preferred, way of generating a starting display is to have the device start with the desired solution, e.g., a display with all the indicators of the same state or a display with the four corner indicators of the opposite state as the rest of the indicators, and the like.

A desired pattern is first selected using PATTERN button 52. The user then presses a STEPS button 58 to select the number of steps which the micro-controller is to randomly take from the starting display using the preselected pattern. When START button 54 is pressed, the steps are then quickly taken by the device and the generated display is presented to the user for solution.

In these and other embodiments it may be desirable to display, using the indicator array, the number of steps selected, the pattern selected and other useful information.

Use of this facility presents an effective way of learning to use the puzzle. For example, novices can ask the device to take just a single step from the starting display. This allows the user to reach the solution in a single step. Once the user gains some expertise, he may ask that two steps be taken, which increase the challenge considerably. More advanced players can ask for three steps, while expert players may be able to handle starting displays generated using four, five or more steps.

Use of this method of generating starting displays has an advantage is that the user is assured throughout that there is a solution to the puzzle since the starting display was generated from the solution using the same pattern as is being used to arrive at the solution and since, as can be shown, the exact sequence of selections is not important.

Another useful feature is activated by a TRACE button 60 which allows the user to trace back, or undo, his previous moves. Thus, whenever a user feels that one or more previous moves may have worsened his position he may wish to undo the last one or more moves so as to restore the display to a former condition. This is accomplished by pressing TRACE 60 once for every step which is to be undone.

A CLEAR button 62 may be used to clear the display whenever desired, such as before creating a private starting display, and the like.

A suitable audio outlet, or speaker 70 may be used to provide various audio signals in conjunction with the puzzle device.

In addition, the device may include various other features which will be readily apparent to those skilled in the art, including, but not limited to, the ability to store a game for resumption at a later time, the ability to present the same starting display to two or more players, including, if desired, the ability to count the number of steps and/or the amount of time needed to reach the solution, means for keeping score, and the like.

Various means for selecting an indicator may be envisioned. One such means is shown in FIG. 11 wherein a joystick 80 is used to move a cursor 82 over the display to a desired indicator 12. Once in the desired location, the selection can be made by depressing a suitable button, which may be located on joystick 80 itself.

Figure 12:
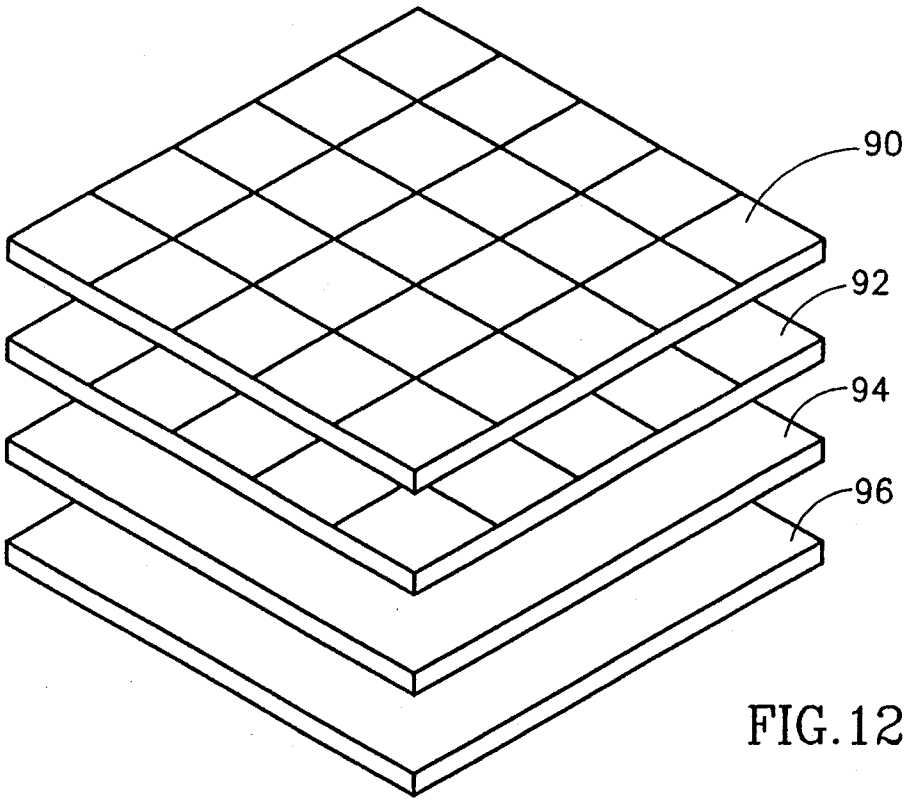
FIG. 12 is an exploded view of a touch screen array mechanism for use with a device implementing a puzzle according to the present invention.
Figure 13:
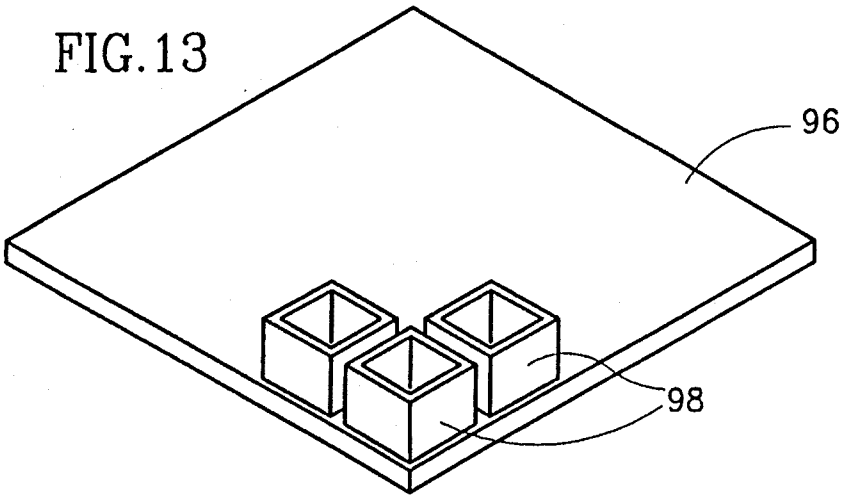
FIG. 13 is a perspective view of an array of switches for use with a device implementing a puzzle according to the present invention.
Figure 14:
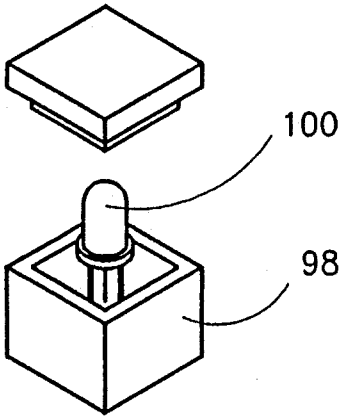
FIG. 14 shows an exploded view of a portion of the switch array of FIG. 13, showing an LED and an associated switch.

Two alterative, and preferred, means for selecting an indicator are shown in FIG. 12 and in FIGS. 13–14, respectively.

Shown in FIG. 12 is a touch screen mechanism which is activated through the touching of a portion of the screen by the finger of the user or by a special implement held in the hand of the user. The touch screen mechanism typically includes a transparent touch screen 90 which is marked to clearly indicate the various cells or indicators which can be selected. Located below touch screen 90 is a liquid crystal display (LCD) 92 for displaying one or the other of the states of each indicator. The marking of touch screen 90 may be permanent or may alternatively be effected by LCD 92. Optionally, located beneath LCD 92 is an electro-luminescent lighting layer 94 which helps make the LCD more visible and easier to perceive. Finally, typically located beneath electro-luminescent lighting layer 94 is a printed circuit board (PCB) 96 bearing the various electronic components of the device. To select an indicator, the user simply touches, directly or indirectly, the desired location on touch screen 90.

Shown in FIGS. 13 and 14 is a switch system wherein each of the indicators includes a pressure switch 98 and a light source, preferably a low energy consumption light emitting diode (LED) 100 (FIG. 14). For clarity only three of the 25 switches 98 are shown in FIG. 13. Pressure switches 98 are preferably mounted on PCB 96. To select an indicator the user simply presses the top of the desired switch 98.

While the invention has been described with respect to a limited number of embodiments, it will be appreciated that many variations, modifications and other applications of the invention may be made.

What is claimed is:

1. A puzzle device, comprising:

(a) an array of indicators, each of said indicators capable of alternately indicating a first state or a second state;

(b) means for selecting one of said array of indicators; and (c) means for changing, upon the selection of said one of said array of indicators, the state of at least one of the other of said indicators based on a predetermined geometrical pattern.

2. A device as in claim 1, wherein said indicators are visual indicators.

3. A device as in claim 2, wherein one of said states is indicated by a light on condition and the other of said states is indicated by a light off condition.

4. A device as in claim 2, wherein one of said states is indicated by one color and the other of said states is indicated by a second color.

5. A device as in claim 1, wherein each of said indicators includes a touch screen.

6. A device as in claim 5, wherein each of said indicators includes an LCD.

7. A device as in claim 6, wherein said LCD is backlighted.

8. A device as in claim 1, wherein said means for selecting one of said array of indicators includes a switch.

9. A device as in claim 8, wherein each of said indicators includes an LED.

10. A device as in claim 1, wherein said array of indicators is two dimensional.

11. A device as in claim 1, wherein said array of indicators is rectangular.

12. A device as in claim 11, wherein said array of indicators is square.

13. A device as in claim 12, wherein said array of indicators is 4 by 4.

14. A device as in claim 13, wherein said array of indicators is 5 by 5.

15. A device as in claim 1, wherein said pre-determined pattern includes said selected one of said array of indicators and the adjacent indicators in the same row and column as said selected one of said array of indicators.

16. A device as in claim 1, wherein said means for changing the state of said at least one of the other of said indicators includes a micro-controller.

* * * * *

UNITED STATES PATENT AND TRADEMARK OFFICE

CERTIFICATE OF CORRECTION

PATENT NO. : 5,417,425
DATED : May 23, 1995
INVENTOR(S) : Blumberg, et al

It is certified that error appears in the above-indentified patent and that said Letters Patent is hereby corrected as shown below:

On the title page: Item [19]
under " United States Patent", "Blumberg et al." should be --Olti et al.--

On the title page: Item [75]
after "Inventors:", insert --Avraham Yehiel Olti, 2/35 Misgav, 20100 Karmiel; Gvorav Mihalv Pal Benedek, 43 Weitzman, Kiryat Bialik; Zvi Herman, 4/1 Hakim, 35430 Haifa;

Signed and Sealed this

Twenty-sixth Day of September, 1995

*Attest:*

Bruce Lehman

BRUCE LEHMAN

*Attesting Officer*

*Commissioner of Patents and Trademarks*